US006527514B2

(12) United States Patent
Roeloffs

(10) Patent No.: US 6,527,514 B2
(45) Date of Patent: Mar. 4, 2003

(54) TURBINE BLADE WITH RUB TOLERANT COOLING CONSTRUCTION

(75) Inventor: Norman Roeloffs, Tequesta, FL (US)

(73) Assignee: Alstom (Switzerland) Ltd, Baden (CH)

( * ) Notice: Subject to any disclaimer, the term of this patent is extended or adjusted under 35 U.S.C. 154(b) by 30 days.

(21) Appl. No.: 09/877,083

(22) Filed: Jun. 11, 2001

(65) Prior Publication Data

US 2002/0197159 A1 Dec. 26, 2002

(51) Int. Cl.[7] ..... F04D 29/58
(52) U.S. Cl. ..... 416/97 R
(58) Field of Search ..... 415/115, 116, 415/173.4; 416/96 R, 96 A, 97 R, 92, 224

(56) References Cited

U.S. PATENT DOCUMENTS

| | | | | |
|---|---|---|---|---|
| 3,807,892 | A | 4/1974 | Frei et al. | |
| 4,142,824 | A | 3/1979 | Anderson | |
| 4,236,870 | A | 12/1980 | Hucul, Jr. et al. | |
| 4,474,532 | A | 10/1984 | Pazder | |
| 4,786,233 | A | 11/1988 | Shizuya et al. | |
| 4,818,178 | A | 4/1989 | Sibbersten | |
| 5,140,127 | A | 8/1992 | Stroud et al. | |
| 5,476,364 | A | 12/1995 | Kildea | |
| 5,927,946 | A | 7/1999 | Lee | |
| 6,231,307 | B1 * | 5/2001 | Correia | 415/115 |

FOREIGN PATENT DOCUMENTS

| | | | |
|---|---|---|---|
| DE | 19944923 | A1 | 3/2001 |
| EP | 0753373 | A1 | 1/1997 |
| EP | 0816636 | A1 | 1/1998 |
| EP | 0 816 636 | | 1/1998 |

* cited by examiner

*Primary Examiner*—Edward K. Look
*Assistant Examiner*—Dwayne White
(74) *Attorney, Agent, or Firm*—Burns, Doane, Swecker & Mathis, L.L.P.

(57) ABSTRACT

A blade for a gas turbine includes a tip cap and a tip squealer and passages for cooling fluid extending from a hollow space to the tip squealer. The tip squealer includes a cavity extending from the tip pocket into the tip squealer such that the cooling passage is divided into first and second portions with an exit hole in the cavity and an exit hole on the tip crown, respectively. In case of a blockage of the exit hole on the tip crown, cooling fluid can flow through the additional exit hole into the tip pocket and cool the squealer.

6 Claims, 2 Drawing Sheets

TURBINE BLADE WITH RUB TOLERANT COOLING CONSTRUCTION

FIELD OF THE INVENTION

This invention relates to internally cooled blades for gas turbines and particularly to a cooling construction of the tip portion of the blade.

BACKGROUND OF THE INVENTION

Blades for gas turbines are typically cooled in order to protect the blade material from the high gas temperatures and prevent its oxidation. The cooling effectively increases blade durability and prolongs the operation lifetime of the blades. A proven successful cooling construction for turbine blades provides for internal cooling where a cooling fluid, typically air bled from the compressor of the turbine, flows through passages in a hollow space between the blade pressure sidewall, the suction sidewall, and a tip cap. The tip portion comprises typically the tip cap and a tip squealer, which extends radially away from the pressure and suction sidewalls. The tip squealer has relatively thin walls and is a long distance from the blade internal cooling air. For this reason it is particularly susceptible to the high temperatures of the gas flow. Hence the cooling of this tip portion is particularly important. In order to provide cooling of the tip portion, cooling passages lead from the hollow space within the blade either to the tip pocket or through the tip squealer to the tip crown. The cooling fluid flows through these passages, cools the tip pocket and squealer from within as well as, after exiting through exit holes, on the outside surface, and finally blends into the leakage flow of the gas turbine.

A typical problem encountered during turbine operation is the occasional intentional or unintentional rubbing of the blade tip against the outer heat shield or other components placed on the turbine casing. The rubbing of the blade tip results in smearing of material on the blade tip and in clogging or even blocking entirely the cooling passage exit holes on the blade tip. The cooling of the blade tip is then reduced or even stopped all together and can result in considerable damage to the blade due to overheating.

Several solutions have been presented in order to prevent clogging or blocking of the cooling passages.

European patent application EP 816 636 discloses a rotor blade for a gas turbine with a typical tip squealer and cooling passages designed for the cooling of the tip squealer. The passages extend from a cavity within the airfoil to the pressure side of the blade as well as through the tip cap to the tip pocket of the blade. In case of a rubbing of the tip squealer against an outer heat shield or other component of the gas turbine, material can drop into the exit holes on the tip cap and clog the passage for the cooling fluid. Furthermore, the placement of the cooling passages does not provide an optimal cooling of the outermost tip of the squealer.

In a tip squealer of similar shape, the cooling construction comprises cooling passages extending from a cavity within the airfoil through the tip squealer on the suction side to the suction side tip crown. This provides an efficient cooling of the outermost tip portion. However, there is a high risk that rubbed off material smears into and clogs the exit holes of the cooling passages.

U.S. Pat. No. 5,476,364 discloses a turbine airfoil without a tip squealer and cooling passages extending from an internal cooling passage to the pressure side of the tip of the blade. The cooling passages are oriented in a particular angle with respect to the tip surface of the blade. Furthermore, the exit holes of the cooling passages comprise in particular a cavity defined by a sidewall parallel to the blade surface and the exit hole sidewall. The cavity is said to prevent the exit hole from clogging with material rubbed off from an annular shroud about the airfoils. Instead, rubbed off material is said to divert the cooling fluid flow to a more advantageous direction in view of turbine performance. This cooling construction is likely to work if blade tip rub is light. However, if the blade tip rub is deeper than the cooling hole diameter, the cooling passage is likely to plug.

SUMMARY OF THE INVENTION

The invention provides a gas turbine blade with a tip squealer and a cooling construction for the tip squealer that allows cooling fluid to reach the outermost edge of the tip squealer. In particular the cooling construction is to provide sufficient cooling even after an intentional or unintentional rubbing with the outer heat shield or other turbine component has occurred and cooling passages have been blocked or contaminated due to light or heavy blade tip rubs.

A turbine blade for a gas turbine extending from a root to a tip and with a pressure side and a suction side comprises a pressure sidewall, a suction sidewall and a tip cap. The inner surfaces of the pressure and suction sidewalls define together with the inner surface of the tip cap a hollow space with cooling passages through which a cooling fluid flows, convectively cooling the blade from within. The tip portion of the blade comprises the tip cap and a tip squealer extending radially away from the pressure and suction sidewall to a pressure and suction side tip crown. Together with the outer surface of the tip cap the tip squealer defines a tip pocket. Further cooling passages extend from the cavity within the blade to the tip squealer allowing cooling fluid to exit from the hollow space within the blade and cool the tip squealer.

According to the invention the tip squealer comprises a cavity extending from the tip pocket into the tip squealer. This cavity reaches into the cooling passages from the hollow space to the tip crown of the squealer such that these cooling passages are divided into a first and second portion. The first portion leads from the hollow space to an exit hole in the cavity and the second portion leads from the cavity to an exit hole on the squealer tip crown.

The cavity in the tip squealer provides an additional exit hole for cooling fluid to exit to the tip portion. The tip squealer with the second portion of the cooling passage protects the cavity and the additional exit hole from contact with the outer heat shield or other components and from rubbed off material that may result from such a contact.

In case of such a contact the exit holes on the squealer tip crown get partially or completely blocked by rubbed off material and the cooling fluid can no longer pass through the second portion of the cooling passage to the tip crown in order to cool the squealer from within. Instead the cooling fluid exits through the additional exit hole into the cavity, flows into the tip pocket and from there about the tip squealer to the tip crown. It effectively cools the squealer on its outside surface by dilution cooling and finally blends into the leakage flow of the gas turbine.

In case of no rubbing with turbine components the cooling fluid can flow freely through the first portion into the cavity and on through the second portion of the cooling passage to the tip crown while convectively cooling the squealer from within.

The cooling construction according to the invention thus provides cooling even after a smearing or plugging of the exit hole has occurred. In particular, the cooling fluid reaches the outermost edge of the squealer in both cases of free as well as blocked exit holes. Furthermore, the cooling construction provides cooling regardless of the size of rubbed off material particles.

In a preferred embodiment of the invention, the cavity in the tip squealer is provided on both the pressure side as well as the suction side of the blade. This solution is particularly suitable for blades with exit holes on the tip crown on both the pressure and suction side of the blade.

In a further preferred embodiment of the invention the cavity in the tip squealer is provided on the suction side only. In some blade types the exit holes of the cooling passages on the pressure side of the tip portion are placed below the tip crown. For these exit holes the problem of blockage is not as severe as for the exit holes on the suction side tip crown and hence measures for protecting the exit holes are not as necessary.

The cavity according to the invention has a first sidewall that is substantially in the plane of the outer surface of the tip cap. A second sidewall of the cavity extends from this first sidewall of the cavity to a third sidewall that is substantially parallel to the tip crown of the squealer.

In a preferred embodiment of the invention the second sidewall of the cavity is either curved or straight with sharp comers to the first and third sidewall of the cavity. A cavity with curved or rounded sidewalls is most suitably manufactured by casting. A cavity with a straight sidewall and sharp comers is more suitably manufactured by other methods, such as electro-discharge machining techniques.

In a further preferred embodiment of the invention the tip squealer comprises rounded comers or sharp, for example rectangular comers.

Sharp corners on the tip squealer are advantageous in view of blade tip leakage as the sharp comers generate a higher discharge coefficient.

DETAILED DESCRIPTION OF THE INVENTION

Figure 1:
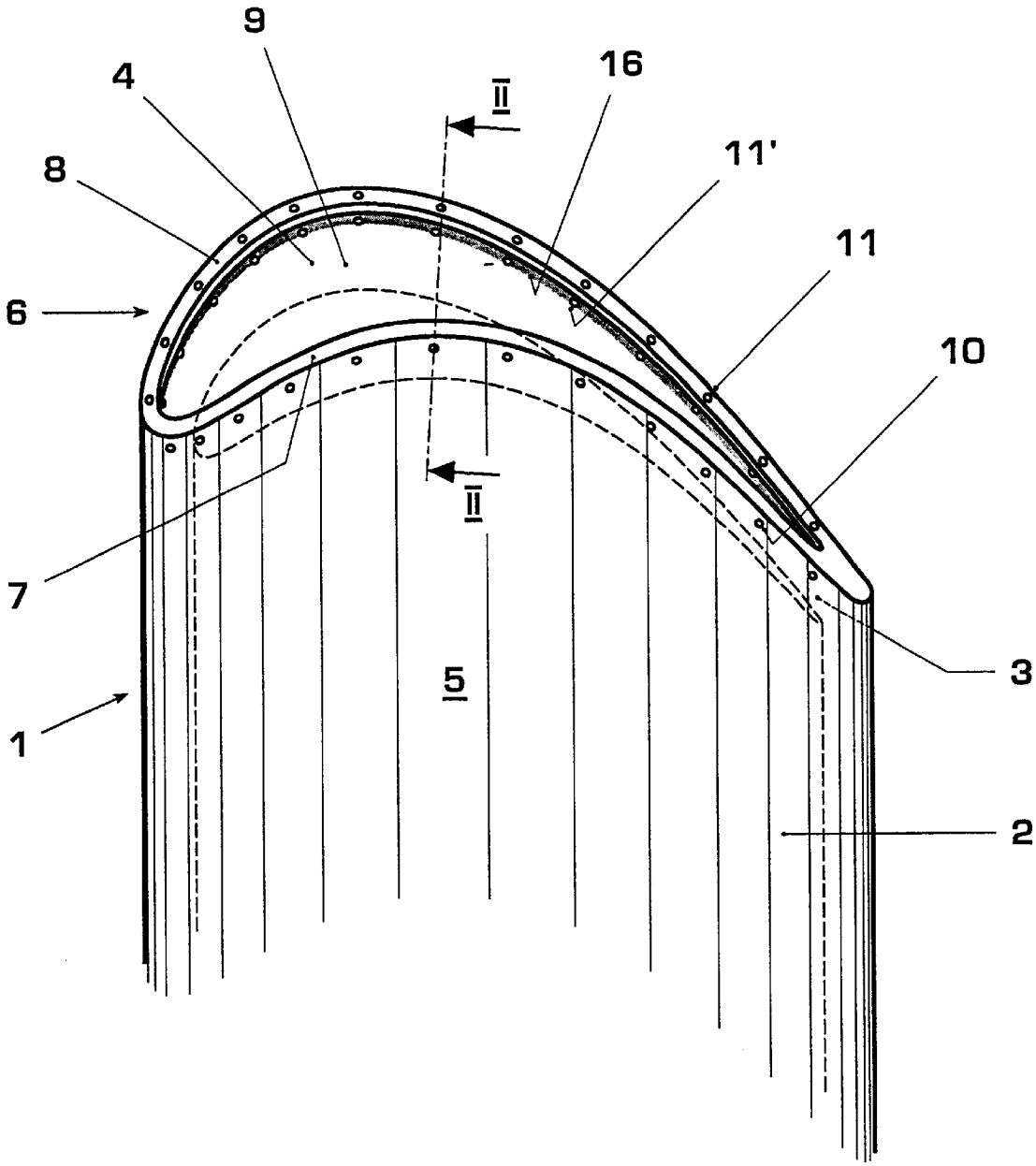
FIG. 1 shows a perspective view of a rotor blade according to the invention with a tip squealer and exit holes of the second portions of the cooling passages on the suction side tip crown and a cavity in the tip squealer exposing the exit holes of the first portions of the cooling passages.

FIG. 1 shows a perspective view of the radially outer portion of a rotor blade 1 for a gas turbine according to the invention with a pressure sidewall 2, a suction sidewall 3, and a tip cap 4 at the radial termination of the blade. Within the rotor blade 1 the inner surface of the tip cap 4 and the inner surfaces of the pressure and the suction sidewalls define a hollow space 5. A cooling fluid, typically air bled from the compressor of the gas turbine, circulates within the hollow space 5, cooling the pressure and suction sidewalls from within by convection.

FIG. 1 shows in particular the tip portion of the blade comprising a tip squealer 6, which protects the blade tip portion from damage in case of contact with the gas turbine casing. The tip squealer extends radially from the pressure sidewall 2 and the suction sidewall 3 to the pressure side tip crown 7 and suction side tip crown 8, respectively. The tip squealer 6 defines together with the tip cap 4 a tip pocket 9. Cooling passages extend from the hollow space 5 within the blade through the tip squealer 6 to the tip portion of the blade. Cooling fluid flows through these passages cooling the tip squealer while cooling it from within. The cooling fluid then exits from the passages through exit holes, cools the tip squealer by flowing about the crown and finally blends into the leakage flow of the gas turbine. On the pressure side of the blade 1 several exit holes 10 of cooling passages are formed in the tip squealer 6, on the pressure side and slightly below the tip crown 7. Several further exit holes 11 of cooling passages are positioned on the suction side tip crown 8.

According to the invention, the tip squealer comprises a cavity 16 extending from the tip cap 4 into the tip squealer 6. The cavity 16 divides the cooling passages near the suction side into a first portion extending from the hollow space 5 to exit holes 11' in the cavity and second portion extending from the cavity to the exit holes 11 on the suction side tip crown 8.

Figure 2:
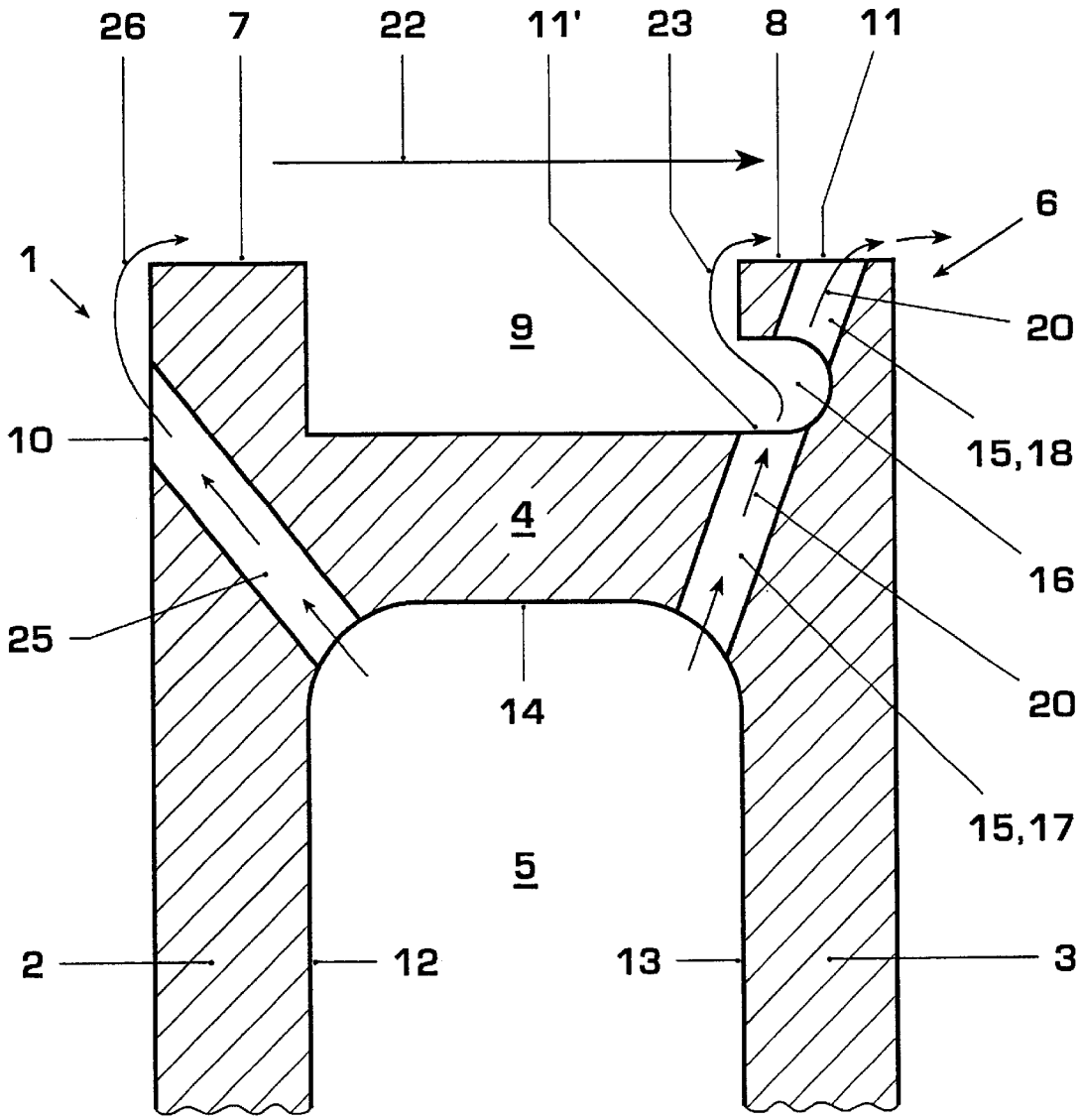
FIG. 2 shows a cross-sectional view taken along the lines II—II in FIG. 1, of the tip portion of a rotor blade according to the invention with the cavity within the tip squealer and first and second portions of a cooling passage.

FIG. 2 shows the cross-sectional view taken along the lines II—II in FIG. 1 of the tip portion of the rotor blade 1 with the pressure sidewall 2 and suction sidewall 3. The hollow space 5 is defined by the inner surface 12 of the pressure sidewall 2, the inner surface 13 of the suction sidewall 3, and the inner surface 14 of the tip cap 4. A cooling passage 15 extends in a first portion 17 from the hollow space 5 through the tip cap 4 to the exit hole 11' and into the cavity 16. The second portion 18 of the passage 15 extends from the cavity 16 through the tip squealer 6 to the exit hole 11 on the suction side tip crown 8.

When the second portion 18 of the cooling passage 15 and its exit hole 11 on the suction side tip crown 8 are clear, the cooling fluid 20 can flow freely to the outermost tip of the squealer and blend into the leakage flow 22. However, if the exit hole 11 is plugged by material rubbed off the outer heat shield or off the blade tip crown, the cooling fluid takes a path 23 from the cavity 16 into the tip pocket 9 and about the tip squealer to the tip crown 8. In both cases a sufficient cooling of the tip squealer, including its outermost edge, is achieved regardless of the degree of plugging of the second portion 18 of the cooling passage.

In the embodiment of FIG. 2, the cavity 16 is shaped with a rounded or curved sidewall, which is most suitably manufactured by casting. A rectangular cavity could also be fabricated, most economically by machining. Both shapes are suitable from the point of view of the cooling fluid flow and cooling effectiveness.

The tip squealer 6 has a shape with either sharp, for example rectangular comers, or rounded corners. In view of blade tip leakage, sharp comers effect a higher discharge coefficient, thus resulting in lower blade tip leakage.

A further cooling passage 25 extends from the hollow space 5 to the pressure side of the blade 1. In the embodiment of the invention shown in FIG. 2, the passage 25 leads to an exit hole 10 on the pressure side of the blade and below the pressure side tip crown 7. The cooling fluid 26 flowing through this exit hole 10 flows about the squealer 6, over the pressure side tip crown 7 into the tip pocket 9, and on into the leakage flow 22. As the exit holes 10 are placed below the tip crown, they are not as susceptible to plugging with rubbed off material as the exit holes on the suction side tip crown and hence do not require protection.

In a variant of the shown embodiment, the cooling passages on the pressure side of the blade could extend all the way to the pressure side tip crown 7, as they do along the suction side of the blade. Similar to the cooling construction on the suction side shown in FIG. 2, the tip squealer comprises a cavity on the pressure side as well that divides the cooling passage into two portions in the same manner as on the suction side of the blade.

In most cases however, cooling passages leading to the pressure side, as shown in FIG. 2, provide sufficient cooling of the tip squealer such that a construction with a cavity is not necessary on the pressure side of the blade.

What is claimed is:

1. A blade for a gas turbine comprising:

a pressure sidewall and a suction sidewall, a tip cap, a hollow space defined by inner surfaces of the pressure sidewall, the suction sidewall and the tip cap, and a tip squealer extending radially from the pressure and suction sidewalls;

a tip pocket defined by an outer surface of the tip cap and the tip squealer;

cooling passages leading from the hollow space to the tip squealer wherein the tip squealer comprises a cavity extending from the tip pocket into the tip squealer such that the cavity divides the cooling passage into a first portion and a second portion where the first portion has an exit hole in the cavity through which cooling fluid can flow into the tip pocket and about the tip squealer and the second portion has an exit hole on the tip crown of the tip squealer.

2. The blade according to claim 1, wherein:

the cavity in the tip squealer extends along both the pressure side as well as the suction side of the blade.

3. The blade according to claim 1, wherein:

the cavity in the tip squealer extends along the suction side of the blade.

4. The blade according to claim 1, wherein:

the cavity comprises a first sidewall that is substantially in the plane of the outer surface of the tip cap, and a second sidewall that extends from the first sidewall to a third sidewall, where the third sidewall is substantially parallel to the tip squealer crown.

5. The blade according to claim 4, wherein:

the second sidewall of the cavity is either curved or straight with sharp corners to the first and third sidewalls.

6. The blade according to claim 1, wherein:

the tip squealer comprises rounded corners or sharp corners.

* * * * *